US005595242A

United States Patent [19]

Jekerle et al.

[11] Patent Number: 5,595,242

[45] Date of Patent: Jan. 21, 1997

[54] HEAT EXCHANGER

[75] Inventors: Jiri Jekerle, Baunatal; Bernd Schope, Kassel, both of Germany

[73] Assignee: Schmidt'sche Heissdampf GmbH, Kassel-Bettenhausen, Germany

[21] Appl. No.: 438,504

[22] Filed: May 10, 1995

[30] Foreign Application Priority Data

May 13, 1994 [DE] Germany ..... 44 16 932.9

[51] Int. Cl.[6] ..... F28D 7/10; F28F 9/02

[52] U.S. Cl. ..... 165/154; 165/158; 165/DIG. 402

[58] Field of Search ..... 165/154, 158, 165/DIG. 402; 122/7 R

[56] References Cited

U.S. PATENT DOCUMENTS

| | | | |
|---|---|---|---|
| 1,848,197 | 3/1932 | Ray et al. | 165/DIG. 402 X |
| 3,387,652 | 6/1968 | Drobka | 165/DIG. 402 X |
| 3,566,961 | 3/1971 | Lorenz et al. | 165/159 |
| 4,168,744 | 9/1979 | Knulle et al. | 165/154 |
| 4,236,576 | 12/1980 | Deuse et al. | 165/158 X |
| 4,254,826 | 3/1981 | Adams | 165/158 X |
| 4,848,449 | 7/1989 | Brucher et al. | 165/160 |
| 5,425,415 | 6/1995 | Master et al. | 165/154 |

FOREIGN PATENT DOCUMENTS

| | | | |
|---|---|---|---|
| 668353 | 8/1963 | Canada | 165/158 |
| 721373 | 1/1955 | United Kingdom | 122/7 R |

OTHER PUBLICATIONS

Jekerle, J. "Fire Tube Boiler in Double–Pipe Design" pp. 13–16, Date Unknown.

*Primary Examiner*—Leonard R. Leo
*Attorney, Agent, or Firm*—Chilton, Alix & Van Kirk

[57] ABSTRACT

The structural integrity and coolant flow characteristics of a heat exchanger which employs double tubes is improved by providing a structural element, which defines an annular chamber through which coolant may flow, about the internal structure which supports the opposite ends of the double tubes. The outer wall of the structure which defines each of the annular chambers in alignment with and welded to, a casing which in part defines a gas entry or exit chamber axially disposed at a first side of the internal tube support structure and to an external support ring located axially at the other side of the internal tube support structure.

11 Claims, 5 Drawing Sheets

HEAT EXCHANGER

Background of the Invention

1. Field of the Invention

The present invention relates to heat exchangers and, particularly, to such devices wherein a hot fluid and coolant are caused to flow through coaxial passages defined by double-walled tubes. More specifically, this invention is directed to improving the mechanical integrity and the efficiency of heat exchangers of the type which employ arrays of coaxial tubes and, especially, to simplifying the construction of such devices. Accordingly, the general objects of the present invention are to provide novel and improved apparatus and methods of such character.

2. Description of the Prior Art

Heat exchanger wherein a heated fluid, and particularly a pressurized hot gas, and a "coolant" are caused to flow along coaxial paths defined by the inner and outer walls of double-walled tubes are well known in the art. A heat exchanger of this type, wherein heat is transferred between two fluids separated by a tube wall, is disclosed in the publication entitled "EVT- Register No. 52/1993" at pages 40–45.

In such heat exchangers, linear arrays or tiers of double tubes extend between a pair of support structures which are known in the art as "tube plates". The tube plates are fabricated from tubular collectors, which are in fluid communication with the annular flow paths of the double tubes, and web plates through which the inner tubes of the double-walled tubes extend. Support ribs extend between the tube plates and structural elements, i.e., a support ring, which surrounds each tube plate and extends axially toward the opposite tube plate. The support rings are connected to casings which define the outer walls of plenum chambers disposed at the opposite ends of the heat exchanger. These chambers receive the fluid flowing through the inner tubes of the arrays of double tubes. The plenum chambers will, respectively, commonly function as a hot gas entry chamber and a gas exit chamber. The tubular collectors communicate with a coolant source or a coolant discharge conduit and, for this purpose, large numbers of apertures must be provided in the support rings.

Heat exchangers of the type briefly discussed above, in part because they must be able to withstand high gas pressures which act on the tube plates, need reinforcement mechanisms and thus are relatively expensive to fabricate. Additionally, coolant flow through such prior art heat exchangers, particularly between the collectors and external coolant delivery and discharge conduits, has been via a large number of relatively small diameter passages which extend through the support rings and thus has been less than optimum. Accordingly, there has been a long standing desire in the art for improvements in double tube heat exchangers.

SUMMARY OF THE INVENTION

The present invention answers the above-briefly discussed long-standing desires by providing and novel and improved heat exchanger. A heat exchanger in accordance with the invention is characterized by an annular chamber located concentrically about at least one of the tube plates. This annular chamber is disposed between and joined to the casing of the adjacent plenum chamber and a support ring which, at least in part, surrounds the tube array. The annular chamber is in fluid communication with the collectors of the tube plate and thus forms part of the coolant flow path for the heat exchanger. The outer wall of the annular chamber defines a structural member, having a very small number of flow ports therein, which transmits pressure induced forces from the support ring to the casing of the adjacent gas chamber. Since this structural connection does not have the large number of flow passage defining apertures which have characterized the prior art, it is better able to transmit forces which occur during heat exchanger operation. Additionally, the flow ports in the outer wall of the annular chamber are of relatively large diameter and, accordingly, the coolant delivery and/or removal conduits may have large cross-sections and improved flow characteristics when compared to the prior art.

A heat exchanger in accordance with the invention is characterized by more efficient absorption and removal of compressive forces resulting from high gas pressure acting on the tube plates. Additionally, the present invention is characterized by a design which significantly reduces fabrication costs. Further, since the coolant delivery and removal conduits can be of large cross-sectional area and be designed to promote coolant flow, a heat exchanger in accordance with the invention is characterized by undisturbed coolant delivery and removal and thus enhanced efficiency.

BRIEF DESCRIPTION OF THE DRAWINGS

The present invention may be better understood, and its numerous objects and advantages will become apparent to those skilled in the art, by reference to the accompanying drawings wherein like reference numerals refer to like elements in the several figures and in which.

DESCRIPTION OF THE DISCLOSED EMBODIMENT

Figure 1:
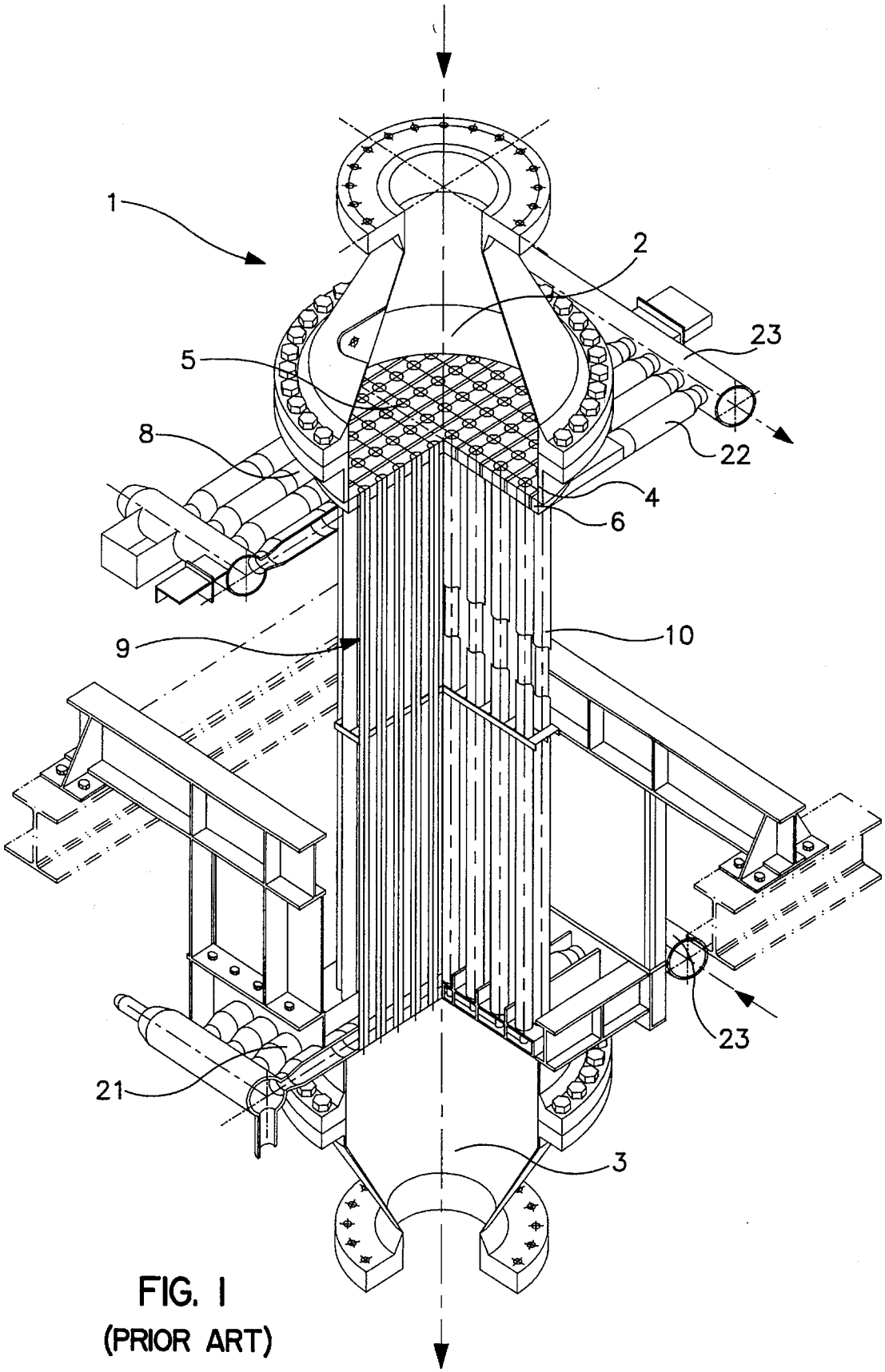
FIG. 1 (PRIOR ART)
FIG. 1 is a perspective view, partly broken away and partly in cross-section, of a double tube heat exchanger in accordance with a first prior art design.
Figure 2:
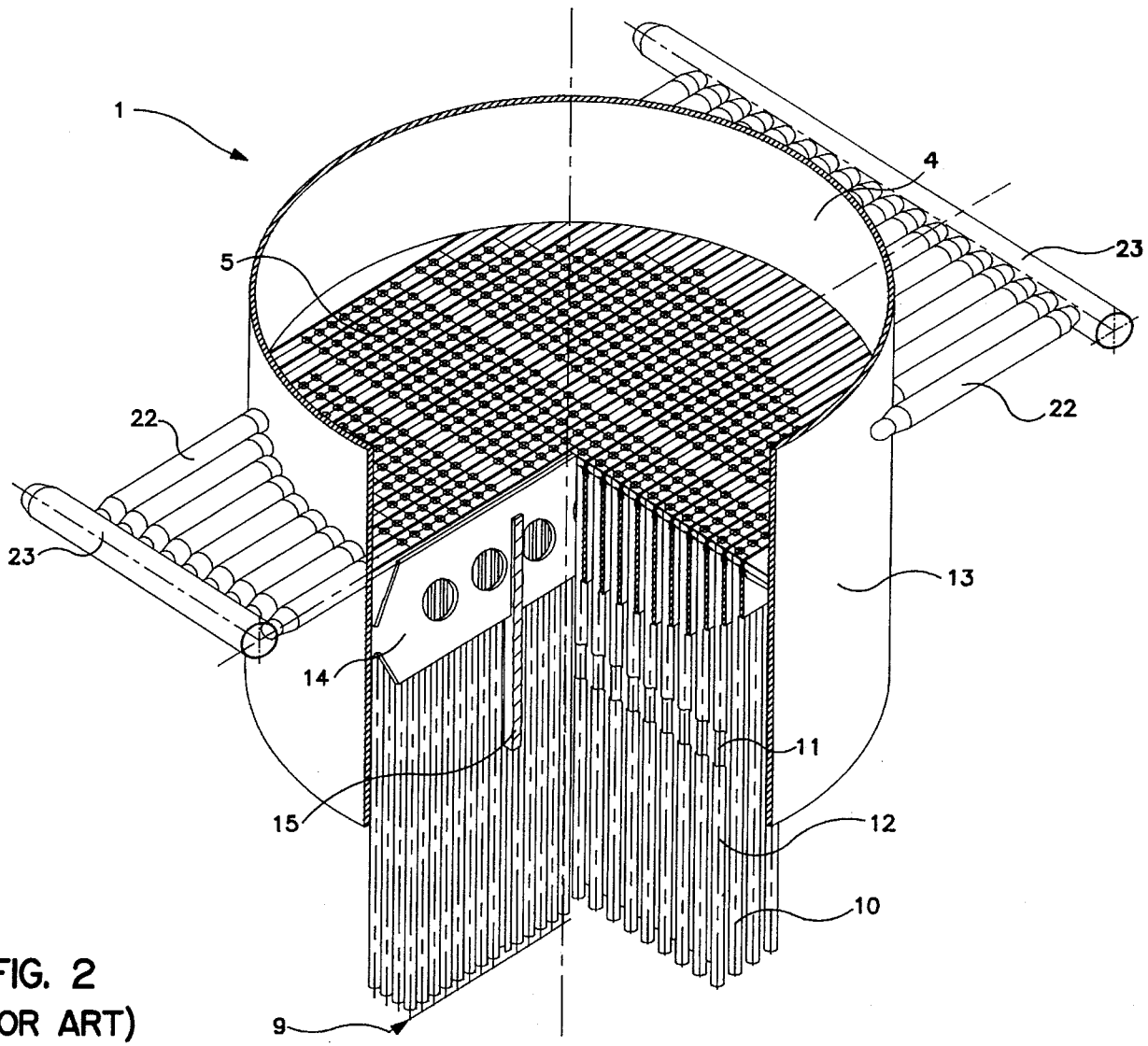
FIG. 2 (PRIOR ART)
FIG. 2 is a perspective view, partly broken away and partly in cross-section, of an alternative design of a prior art double tube heat exchanger.
Figure 4:
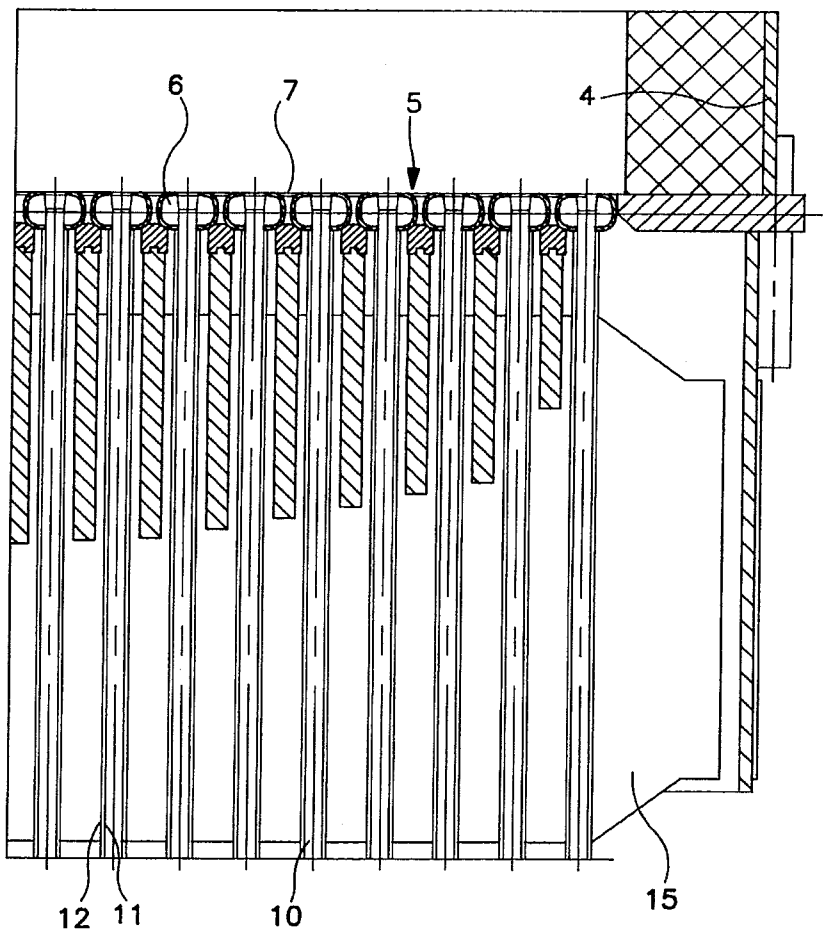
FIG. 4 (PRIOR ART)
FIG. 4 is a cross-sectional, side-elevation view of a portion of the heat exchanger of FIG. 2, FIG. 4 being a view taken traversely with respect to FIG. 3 and also depicting a linear array of double tubes.

To first describe the prior art, the construction of known double-tube heat exchangers, indicated generally at 1, may be seen from FIGS. 1–4. The heat exchangers 1 are of generally cylindrical shape and include linear arrays or tiers, indicated generally at 9, of double tubes 10. As may best be seen from FIG. 4, the tubes 10 are comprised of an inner tube 11 and a coaxial outer tube 12. The double tubes 10 are welded to tube plates, indicated generally at 5, which are defined by collectors 6 and web plates 7. As depicted in FIG.

4, the collectors 6 have a generally oval shape and are in fluid communication with the annular flow paths defined by the spacing between the inner tubes 11 and outer tubes 12 of the double tubes 10. In a typical operating environment, a pressurized gas to be cooled flows through the inner tubes 11 of the double tubes 10 and a coolant, for example water to be evaporated, flows through the annular space between inner tube 11 and outer tube 12. The annular spaces, together with a collector 6, forms the water-vapor space of a tier of tubes 9.

The tiers or linear arrays 9 of double tubes 10 are, as noted above, united into the cylindrical heat exchanger configuration by means of being welded to the tube plates. Restated, the inner tubes 11 pass through the plates 7 and are welded thereto while the outer tubes 12 are welded to the collectors 6 which, in turn, are also welded to the web plates 7. A casing 4, which defines the outer wall of a gas entry chamber 2, and a similar casing, which defines the outer wall of a gas exit chamber 3 (see FIG. 1), are also joined to tube plates 5. A supporting ring 13 is welded to each of the tube plates 5 and extends therefrom toward the opposite tube plate. The support rings 13 have been integral with the adjacent casings 4 or joined thereto by the peripheral portion of a tube plate 5. In accordance with the prior art, the ends 8 of the individual collectors 6 extend through a supporting ring 13 and are coupled to individual conduits 21, 22 which, in turn, lead to a common collector/supply duct 23. If the heat exchanger is operated as a counter-flow device, the chamber 2 will function as a gas entry chamber and the duct 23 will function as a coolant collector.

Continuing to discuss the prior art, the tube plates 5 must be able to withstand high gas pressures. Accordingly, referring to FIG. 2, the upper tube plate 5 is supported by transversely oriented ribs 14 and 15. Compressive forces imposed on plate 5 will be transferred by the ribs to the supporting ring 13. Since the ring 13 is integrated with the outer casing 4 of the gas entry chamber 2, which is part of the overall support structure for the heat exchanger, the forces will be transferred to the support structure. Obviously, the same type of construction will be employed at the bottom end of the heat exchanger as may be seen by examination of FIG. 1.

Figure 3:
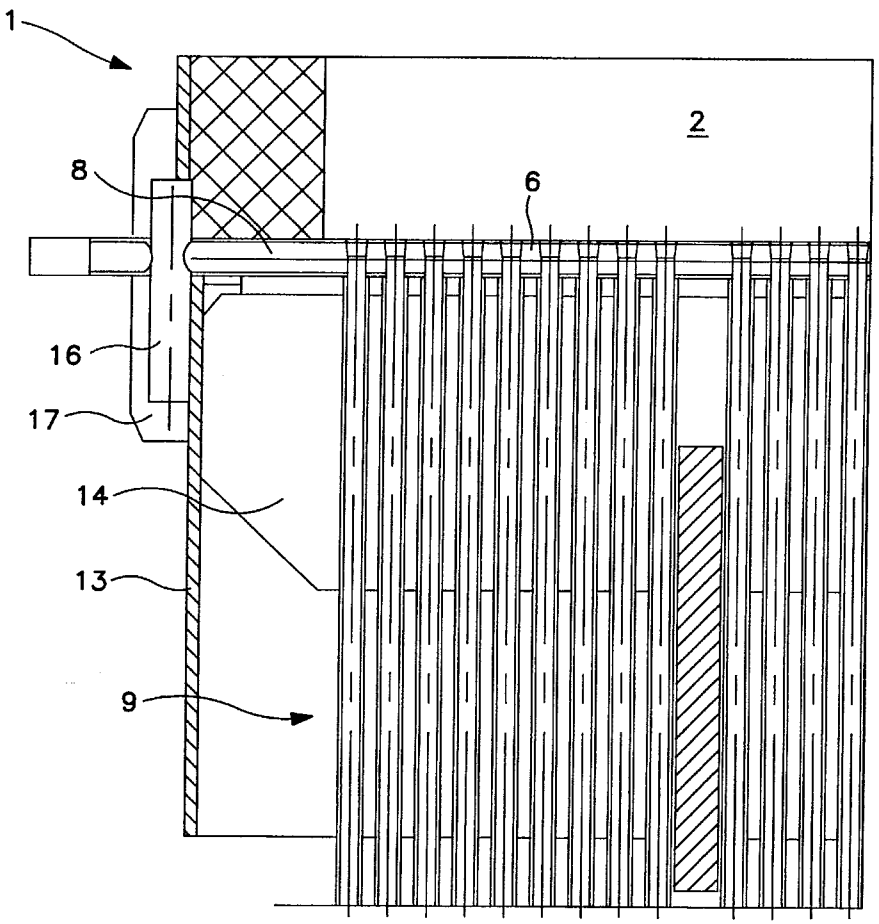
FIG. 3 (PRIOR ART)
FIG. 3 is an enlarged, side-elevation view of a portion of the heat exchanger of FIG. 2, FIG. 3 depicting a linear array of the double-walled tubes of the heat exchanger.

Referring to FIG. 3, because of the numerous apertures which were provided in supporting ring 13 in order to establish fluid communication between the collector ends 8 and the ducts 23, reinforcement of the supporting ring 13 in the region of the tube plates was required. To this end, referring to FIG. 3, bolts 16, extending through flanges, and outer ribs 17 were provided in the prior art.

Heat exchangers of the type depicted in FIGS. 1–4 are operated almost exclusively by natural circulation and, accordingly, are as a rule arranged vertically. The gas to be cooled may, of course, be supplied either from the top of the heat exchanger, as indicated by arrows in FIG. 1, or from the bottom. The coolant will typically be directed through the heat exchanger from the bottom to the top as represented by the flow arrows associated with the ducts 23 of FIG. 1. As will be appreciated by those skilled in the art, vertical orientation of the axes of the double tubes 10 is not required.

Figure 5:
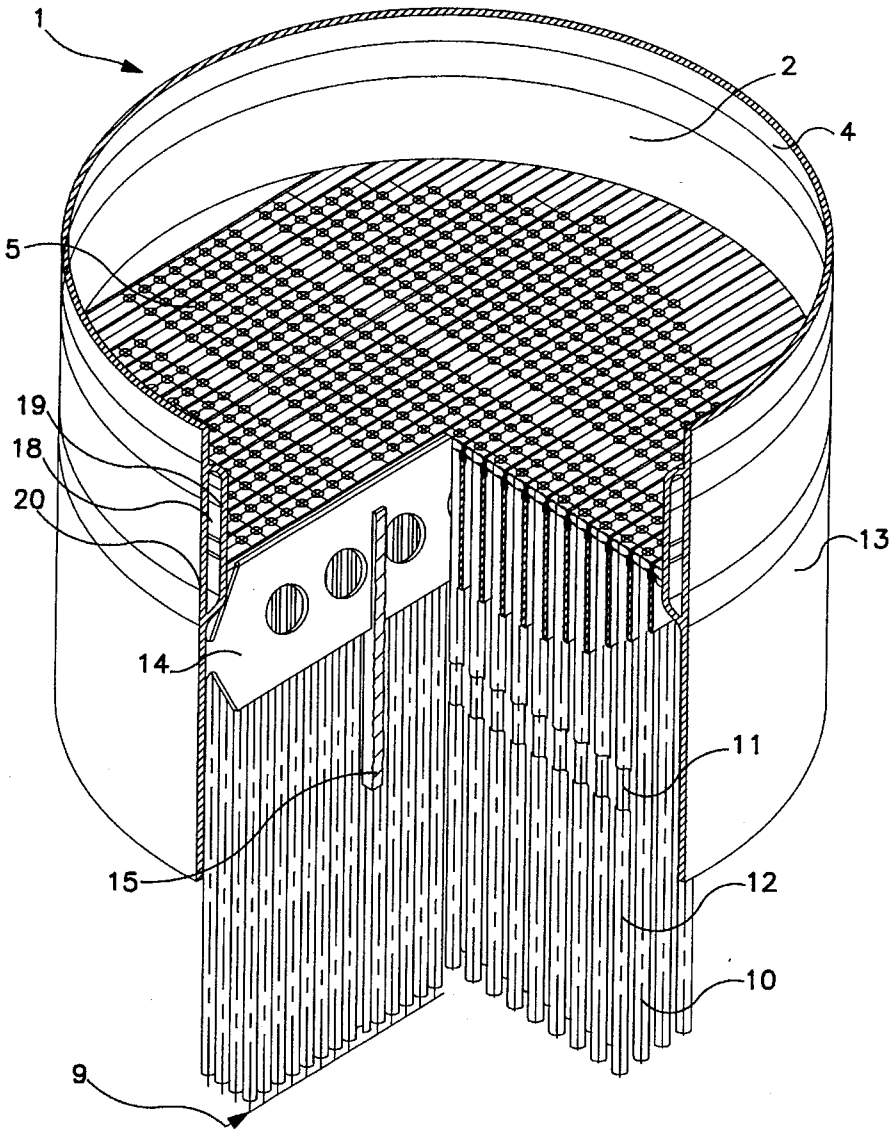
FIG. 5 is a perspective view, partly broken away and partly in cross-section, of a heat exchanger in accordance with the present invention.
Figure 7:
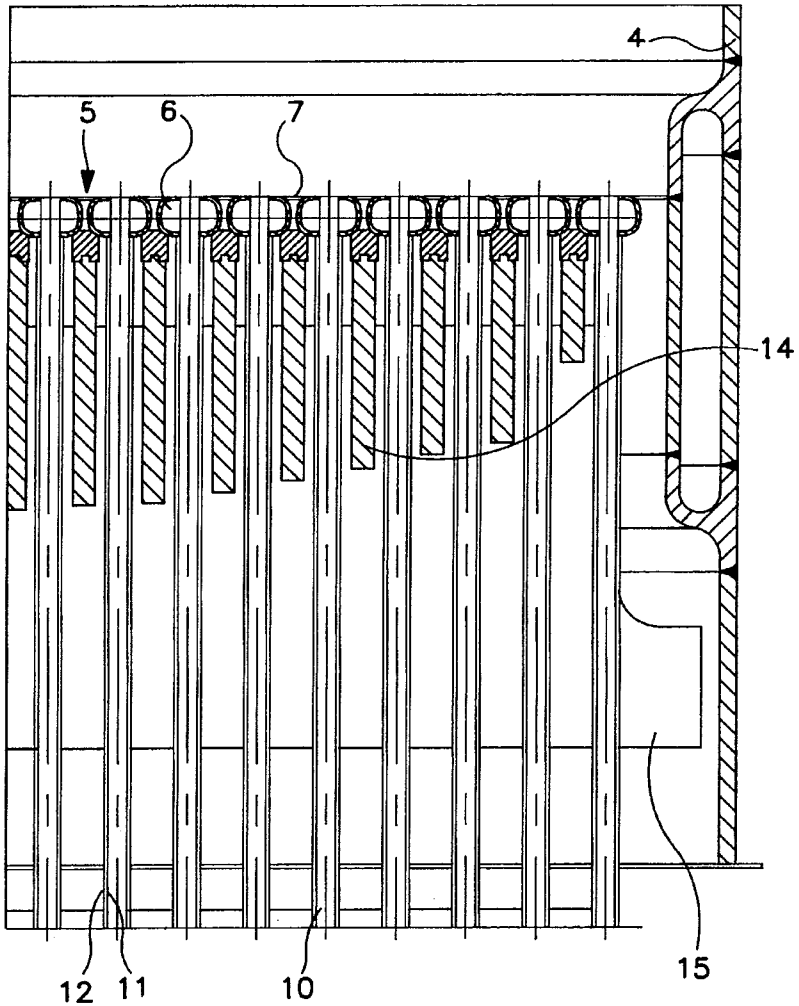
FIG. 7 is a view similar to FIG. 4 but of the heat exchanger of FIG. 5.
Figure 6:
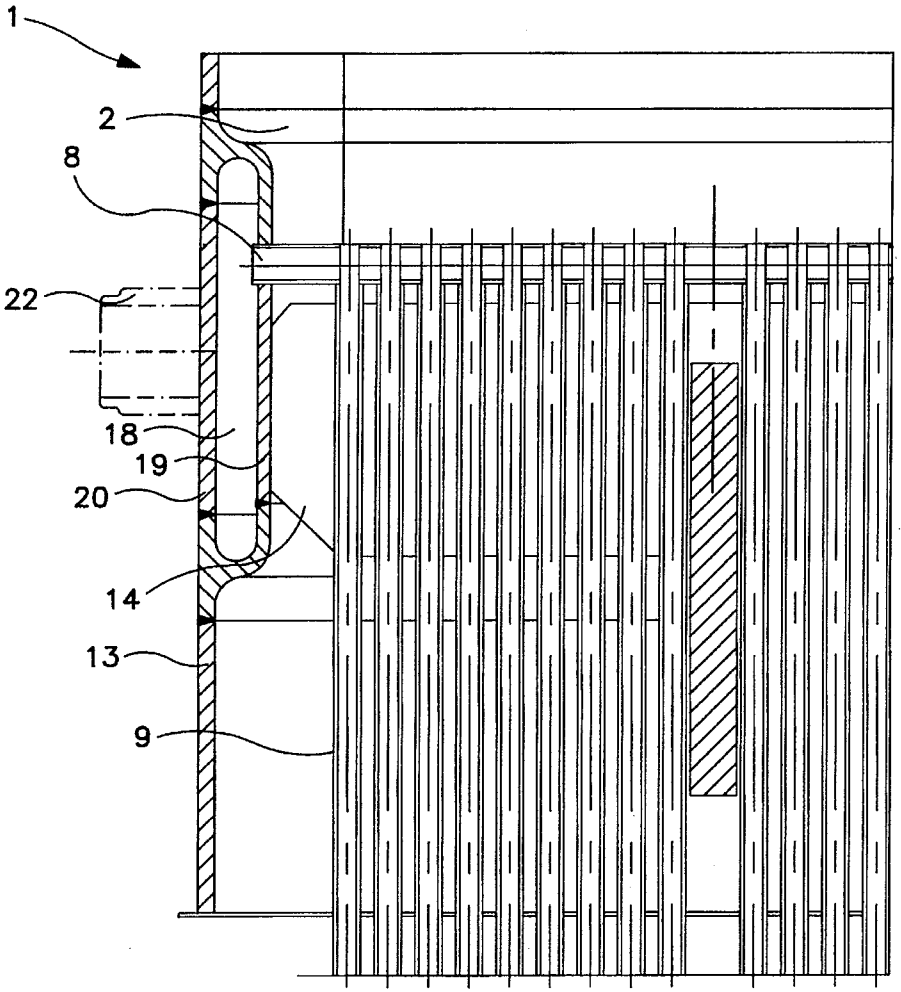
FIG. 6 is a view similar to FIG. 3 but of the heat exchanger of FIG. 5.

With reference now to FIGS. 5–7, a heat exchanger in accordance with the present invention is shown. The heat exchanger 1 of FIG. 5 is of the same general construction as the prior art heat exchanger of FIGS. 2–4. However, the principles of the invention may be applied to a heat exchanger of the type depicted in FIG. 1. In accordance with the invention, the transition from the outer casing 4 of the gas entry chamber 2 to the adjacent supporting ring 13 is in the form of a subassembly which defines an annular chamber 18. It will be appreciated that the same construction may, and typically will be, employed as the transition between the casing of the gas exit chamber 3 (see FIG. 1) and the adjacent support member. The annular chamber 18 surrounds the tube plate 5. Also, the outer wall 20, which in part defines annular chamber 18, is preferably flush with the casing 4 and the support member 13 which it interconnects. The supporting ribs 14 of the tube plate 5 are shown as being welded to the inner wall 19 of chamber 18. The transversely oriented ribs 15 will be welded to the wall 19 and/or to supporting ring 13. The ribs thus cause the transfer of compressive forces, induced by the action of pressurized gas in chamber 2 on plate 5, to the casing 4 of the gas entry chamber 2 via a ring-shaped supporting member.

As may be seen from FIG. 6, the ends 8 of the collectors 6 extend through inner wall 19 to thereby place the collectors in fluid communication with the annular chamber 18. Coolant exit connections 22 extend through the outer wall 20 of annular chamber 18. These exit connections 22 have a large cross-section and are arranged so as to promote coolant flow. In actual practice, it has been found that improved coolant flow characteristics may be achieved through the use of at most four connections 22. It will be understood that the arrangement of the coolant flow paths as depicted in FIGS. 6 and 7, including the exit connections 22, will be repeated at the opposite end of the heat exchanger in order to supply the coolant to the heat exchanger via conduits 21.

A significant aspect of the present invention resides in the establishment of a mechanical connection between the tube plates 5, their adjacent supporting rings 13 and a gas chamber casing which, without any additional reinforcements such as the bolts 16 and ribs 17 of FIG. 3, will withstand the applied forces and transfer those forces to the gas chamber casings. The present invention thus provides a simplified construction, which reduces the cost of fabrication of the heat exchanger, while at the same time improving the coolant flow characteristics through the use of fewer coolant supply/discharge connections of larger diameter when compared to the prior art.

The annular chamber 18 is, as clearly shown in FIGS. 5–7, of elongated oval shape with the longitudinal axes of the oval being substantially parallel to the axes of tubes 10.

Chamber 18 is perferably a welded subsystem wherein the weld seams are all easily accessible and all welds in the inner wall 19 are offset with respect to the weld seams in outer wall 20. As shown in FIGS. 6 and 7, the annular chamber 18 is actually comprised of three members which are fusion bonded together along three weld seams.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. In a heat exchanger wherein a hot fluid and a coolant are caused to flow through double tubes having first and second ends, each of the double tubes defining an inner flow path and an annular outer flow path which is coaxial with the inner flow path, the tubes being supported adjacent their first ends by a first tube plate, the first tube plate defining a first plane and being in part comprised of a first web plate, the first web plate in part defining a first wall of a first plenum chamber to which a pressurized fluid will be delivered, first flow paths of the double tubes being in fluid communication with the first plenum chamber via apertures in the first web plate, the first tube plate further being comprised of plural fluid collectors which are in fluid communication with associated second flow paths of the double tubes the first plenum chamber being further defined by a first casing which forms a second wall Of the first plenum chamber, the first casing being disposed on a first side of the first plane, the heat exchanger further including at least first support means disposed on an opposite side of the first plane with respect to the first plenum chamber defining casing, the improvement comprising:

means defining a first annular chamber which extends about the periphery of the first tube plate, said first annular chamber defining means having inner and outer walls and a pair of opposite side edges, said first annular chamber defining means being disposed between the first plenum chamber defining casing and the first support means, said first annular chamber defining means outer wall being in alignment with the first plenum chamber defining casing and the first support means, said opposite side edges of said annular chamber defining means being respectively affixed to the first support means and the first plenum chamber defining casing;

means establishing fluid communication between the fluid collectors through said first annular chamber defining means inner wall; and fluid connection defining means extending through said first annular chamber defining means outer wall.

2. The heat exchanger of claim 1 wherein support ribs are provided on the first tube plate, the support ribs being in contact with the first web plate and being bonded to said first annular chamber defining means inner wall.

3. The heat exchanger of claim 2 wherein said first annular chamber has an elongated oval shape, the longitudinal axis of the oval extending between the first plenum chamber defining casing and the first support means.

4. The heat exchanger of claim 3 wherein said fluid connection defining means comprises less than five flow ports in said first annular chamber defining means outer wall.

5. The heat exchanger of claim 2 wherein said fluid connection defining means comprises less than five flow ports in said first annular chamber defining means outer wall.

6. The heat exchanger of claim 1 wherein said first annular chamber has an elongated oval shape, the longitudinal axis of the oval extending between the first plenum chamber defining casing and the first support means.

7. The heat exchanger of claim 1 wherein said fluid connection defining means comprises less than five flow ports in said first annular chamber defining means outer wall.

8. The heat exchanger of claim 1 wherein the double tubes are supported adjacent the second ends thereof by a second tube plate, the second tube plate being spatially displaced from the first tube plate, the second tube plate defining a second plane substantially parallel to the first plane and being comprised of a second web plate which at least in part defines a first wall of a second plenum chamber, the first flow paths of the double tubes being in communication with the second plenum chamber via apertures in the second web plate, the second tube plate being further comprised of plural fluid collectors which are in fluid communication with associated second flow paths of the double tubes, the second plenum chamber being further defined by a second casing which forms a chamber outer wall, said improvement further comprising:

means defining a second annular chamber which extends about the periphery of the second tube plate, said second chamber defining means having inner and outer walls and a pair of opposite side edges, said second annular chamber defining means being disposed between the second plenum chamber defining casing and the first support means, said opposite side edges of said second annular chamber defining means being respectively affixed to the first support means and the second plenum chamber defining casing, said second annular chamber defining means outer wall being in alignment with the second plenum chamber defining casing and the support means;

means establishing fluid communication between the fluid collectors of the second tube plate and said second annular chamber through said second annular chamber defining means inner wall; and second fluid connection defining means extending through said second annular chamber defining means outer wall.

9. The heater exchanger of claim 8 wherein the double tubes and tube plates cooperate to define a generally cyclindrical shaped heat exchanger, the first support means is in the form of at least a first support ring and wherein said first and second annular chamber defining means outer walls are in alignment.

10. The heat exchanger of claim 9 wherein support ribs are provided on the facing sides of the first and second tubes plates, the support ribs being in contact with the first and second web plates and being bonded to respective of said first and second annular chamber defining means inner walls.

11. The heat exchanger of claim 10 wherein said fluid connection defining means comprises less than five flow ports in said annular chamber defining means outer walls.

* * * * *